US005389156A

United States Patent [19]

Mehta et al.

[11] Patent Number: 5,389,156

[45] Date of Patent: * Feb. 14, 1995

[54] DECONTAMINATION OF HYDROCARBON PROCESS EQUIPMENT

[75] Inventors: Nishaneth K. Mehta; Richard W. Krajicek, both of Houston, Tex.

[73] Assignee: Serv-Tech, Inc., Houston, Tex.

[ * ] Notice: The portion of the term of this patent subsequent to Oct. 18, 2011 has been disclaimed.

[21] Appl. No.: 61,187

[22] Filed: May 13, 1993

Related U.S. Application Data

[63] Continuation-in-part of Ser. No. 998,556, Dec. 30, 1992, Pat. No. 5,356,482, which is a continuation-in-part of Ser. No. 805,367, Dec. 10, 1991, abandoned.

[51] Int. Cl.[6] ..... B08B 3/00; B08B 3/08; B08B 9/00

[52] U.S. Cl. ..... 134/10; 134/11; 134/22.1; 134/22.14; 134/22.15; 134/22.19; 134/30; 134/31; 134/34; 134/39

[58] Field of Search ..... 134/11, 22.1, 22.14, 134/22.15, 22.19, 30, 31, 34, 10, 39

[56] References Cited

U.S. PATENT DOCUMENTS

| | | | |
|---|---|---|---|
| 1,722,211 | 7/1929 | Guardino | 134/22.15 |
| 1,891,592 | 12/1932 | FitzGerald | 134/31 |
| 2,023,496 | 12/1935 | Todd | 134/22.15 |
| 2,715,594 | 8/1955 | Garrison | 134/22.15 |
| 3,084,076 | 4/1963 | Loucks | 134/22.15 |
| 4,446,044 | 5/1984 | Rutkiewic et al. | 252/DIG. 14 |
| 4,511,488 | 4/1985 | Matta | 252/162 |
| 4,790,951 | 12/1988 | Frieser et al. | 252/162 |

*Primary Examiner*—Richard O. Dean
*Assistant Examiner*—Zeinab El-Arini
*Attorney, Agent, or Firm*—Jenkins & Gilchrist; John R. Kirk, Jr.

[57] ABSTRACT

Contamination can be removed from equipment of a chemical processing flow path by pumping through the plant an aqueous solution at an elevated temperature of an extractant, such as terpene, and a surfactant mixture which traps contaminants for disposal in an environmentally acceptable manner.

18 Claims, No Drawings

DECONTAMINATION OF HYDROCARBON PROCESS EQUIPMENT

RELATED APPLICATION

This application is a continuation-in-part of application Ser. No. 07/998,556, filed Dec. 30, 1992, now U.S. Pat. No. 5,356,482, which was a continuation-in-part of application Ser. No. 07/805,367, filed Dec. 10, 1991, now abandoned.

FIELD OF THE INVENTION

This invention relates to the decontamination of hydrocarbon process equipment and vessels to remove contaminants, particularly benzene, during turn-around periods to clean the equipment and make it safe for service personnel to be exposed to the equipment during internal inspection, maintenance and repair. Specifically, it involves a unitary cleaning of all or part of the process flow-path which allows an extractant-based decontamination solution to be introduced into the processing system at the beginning of a process stream being cleaned and to recover it from the end of the process for disposal or reuse.

BACKGROUND OF THE INVENTION

In the chemical process and petroleum refining industries, maintenance and often capital improvements of process plants occur on a scheduled basis, either annually, biannually, or less often, if possible, at scheduled times when the operating unit is completely shut down and every aspect of its operation inspected and maintained. Operating units are made up of various types of vessels; i.e., tanks, heat exchangers, distillation columns, reactors and the like in fluid communication with each other. Characteristically, in refining and petrochemical operations, a feed, such as crude oil, is introduced to one end of the plant, with hydrocarbon product stream being removed at the other end, to storage or transporting facilities. Of course, any similar process flow-stream equipment is also cleaned. This massive maintenance effort on each unit is called a turnaround and maximum speed in returning the unit to operation is essential to the plant economics, since the main cost of such an operation, even though itself expensive, is the time during which this operating unit is not producing refined product which can be sold. The speed at which the jobs are done are, of course, tempered with the necessity that safety of the workers be maintained throughout the operation.

During a turnaround, an operating process cannot merely be shut down and drained to allow entry of maintenance and repair crews. The process equipment must first be rendered safe and decontaminated of any residual material in it which may be harmful, even fatal, to the workers who must enter to inspect and maintain, if not refurbish, the internal structure of the equipment. In maintaining and repairing the processing equipment, it has normally been necessary to clean and decontaminate single, or groups of vessels, before entry for maintenance and repair. The present practice, depending upon the equipment, uses a light hydrocarbon solvent to initially remove heavy oils and tars, followed by injection of steam for a period of time until monitoring devices indicate that no dangerous gases remain which present an explosive hazard to workers who must work in this environment. Process equipment was also washed with water to remove contaminants where applicable, and often, both steaming and water washing is involved in the degassing of a vessel to make it possible for humans to safely enter to inspect and repair. These steps often take many hours, even days, to accomplish—days of lost production. The often ineffective steam purging step is eliminated; after the solvent step, also. It is desirable of course to effectively clean and decontaminate the entire process flow-path at one time.

Following degassing, prior art methods of cleaning processing systems typically relied upon chemical reactions wherein strong or weak, inorganic or organic acids, bases, or chelating agents (such as HF, HCl, $H_2SO_4$, citric, acetic, and hydroacetic acids or EDTA, DTPA, and similar chelating agents) were pumped through the process vessels and equipment to remove inorganic metallic oxide scales, corrosion products and hydrocarbon deposits. Unfortunately, corrosive chemicals aggressively attack not only the scales and contaminants, but also the materials of construction, as well as the contamination and could not be pumped through existing process pumps or lines because they can cause damage to the mechanical seals of the pumps. It was necessary to incorporate independent, smaller pumps and smaller lines to perform the cleaning process, resulting in slower, less efficient cleaning. And of course, an acid cleaning required a flushing step, a neutralizing step, and another flushing step—all requiring the handling of chemicals difficult to dispose of and causing further time delays. Less reactive chemicals did not fully clean the equipment either. Neither treatment processes accomplish vapor phase cleaning and remove dangerous volatile organic contamination.

Of particular importance to the safety of workers is the removal of benzene and other volatile organic carbon components from the process vessels. It has been long recognized that chronic exposure by humans to benzene at high levels in the chemical and petrochemical work place leads to bone marrow depression, aplastic anemia, and leukemia. Although absorption of benzene across the skin as a vapor or in aqueous media can occur, benzene toxicity in process systems is most frequently caused by inhalation of benzene that has managed to escape removal. Present government safety standards for eight hour work days are set at 1.0 ppm (average) benzene. The National Institute For Occupational Safety And Health (NIOSH) has recommended (1989) an occupational long term exposure limit in air of 0.1 ppm benzene. That is not good enough, since workmen employed by turn-around service companies are continually exposed to the interior of process vessels. Worker safety regulations now limit such exposure. One major goal of the present invention, therefore, is to provide a process for process equipment decontamination which exceeds this standard—in fact, which approaches, if not meets, 0 ppm of benzene. Benzene is often found to be trapped beneath scale or other contaminants anywhere along the process flow stream—in piping, in valves, and in pumps, as well as towers, reactors, tanks and heat exchangers—only to seep out from the interstices of contamination deposits at a later time when cleaning had been thought to be completed or to collect in head space of the vessel. Until now, there was no process for decontaminating the entire process flow-path with one unitary process.

Even though there are many conflicting problems which converge on the process equipment, still, the overriding requirements are speed with safety, and the practice of this invention accomplishes these while providing avenues for a more effective protection of the environment. This invention allows almost pristine cleaning of process equipment—from the crude oil feed pump to product storage tank—without even opening them, in many cases until safely decontaminated of dangerous substances, particularly such as benzene.

SUMMARY OF THE INVENTION

This invention involves an improvement over old methods of decontaminating and cleaning process equipment by introducing into the process equipment, preferably at the location of the feed stream of the material being processed when the equipment is on line, an aqueous solution of an extractant having an affinity for the contaminant and a surfactant such that the aqueous solution proceeds through the entire process stream including piping, pumps and process equipment (except for those selected by plant personnel which may be harmed by the introduction of non-process substances), and then retrieving the aqueous solution either for disposal in an environmentally benign way or by cleaning and reuse at the product end of such process stream. The process of this invention uses materials which are nonhazardous, which do not create additional waste, and which can be disposed of by merely introducing them into the plant's biological waste water system where they can be handled by the biosystem on a routine basis.

Initially, the processing system equipment may be drained while hot and flushed with a light hydrocarbon solvent to make an initial cleansing, though not absolutely necessary in the practice of the invention. A sufficient amount of water would be introduced into the process flow equipment to provide a head for pumps, preferably the process pumps, to be used to circulate it through the process flow equipment to be cleaned. Steam would then be injected into the system to heat the water, now circulating, and process equipment from the feed inlet to the exit means to a temperature of from about 160° F. to about 270° F. The cleansing injection is continued by incorporating into the steam an extractant, which is a vapor at the steam conditions, having an affinity for the contaminating material being removed, such that the steam and the extractant will condense on inside surfaces of the equipment in the process flowpath to remove and trap the contamination. It is preferred that a surfactant which boils at, or has a high vapor pressure within, the same temperature parameters also be included with the steam to enhance the invasion of the contaminant containing interstices of deposits and wash down of the internal surfaces of the process equipment with both condensed water and extractant. The circulating water heated by the steam also contains extractant and surfactant, if present, and in addition to sweeping contaminants from the system, serves to perform the cleaning function upon the surfaces contacted by it.

A terpene extractant material is preferred based upon its boiling point and vapor pressure and the solubility of hydrocarbon contaminants in the extractant. Even if the surfactant and extractant do not boil in the temperature range of the steam, if the partial pressure of these two components is sufficiently high at cleaning conditions, vapors will be dispersed throughout the process flowpath and will condense to invade the interstices of the contaminant material and matrix of the hydrocarbon scale to assure extraction and removal of the contaminants. It has been discovered that this process is particularly effective in thoroughly removing benzene from the equipment. Condensation of the vapors throughout the closed process equipment creates sufficient force to extract the contaminants from the interstices and even break down the scale particles themselves. The chemical formulation is capable of uniformly carrying microsolids or colloidal solids in an emulsion along with the hydrocarbons such that damage to pump seals and packing is minimized. The emulsification properties of the surfactants for the particular contamination are considered in the selection of the particular material used.

The chemical formulations useful in the invention are capable of emulsifying and dissolving a wide range of typical hydrocarbon process industry contaminants such as tars, resins, ashphaltenes, and organic polymers that might normally have been removed using aromatic or aliphatic solvents (some of which may be carcinogenic or teratogenic) and strong alkaline-based detergents The decontamination solutions of this invention are not aggressive; they are non-reactive, and safe for use with the metallurgy normally found within hydrocarbon processing units. This characteristic allows the circulation of the decontamination solution using the standard process pumps already in place, thus allowing full and maximum use of system pressure and flow ratings without the damage to pump seals and packing which had been experienced during cleaning using reactive chemicals. In fact, the flow of the present chemical formulations may be controlled and monitored from the chemical plant's own control room. Surprisingly, observation of the interior of the equipment after cleaning approximates the appearance of new equipment. The surfaces are so clean that, in the case of mild steel, a patina of oxidation quickly forms.

DETAILED DESCRIPTION OF THE INVENTION

The cleaning process of this invention is applicable to almost any, if not all, hydrocarbon processing system. For example, the process with selections made within the skill of those in the art to select the extractant and surfactant, if used, may be used to clean any units within the normal refining and hydrocarbon processing industry. For example, the units would include, but not be limited to, crude oil units, vis-breaker systems, hydrocrackers, hydrotreaters (including the reactor), fluid cat cracking systems (except for the cracking unit itself), delayed coking units, ethylene thermal crackers, amine units and other associated vessels. For example, each of the units would have heat exchangers associated with them and some involve direct heating furnaces, such as, for example, the crude unit train. If hydrocarbon processing equipment for high temperatures are used, the prospect of coking occurs and it has surprisingly been found that the process of this invention has a salutary effect on the decoking of heaters and equipment.

In petroleum refining processes, the normal refining process starts with a crude preheater with heat exchangers and a furnace, preliminary to entering an atmospheric distillation tower for the straight run cuts of gasoline followed by a number of processing vessels, depending upon the materials processed and the processing steps taken in the refining process. Heretofore, these vessels were cleaned either with aggressive acids as described before or taken out of service and separately cleaned using appropriate cleaning methods for the contamination involved. Surprisingly, the process of the present invention decontaminates the equipment to make it safe for workers by circulating the solutions into the initial feed stream and on through the system following the flow path of the hydrocarbon. Of course, it can be fed into other parts of the system and removed at the product exit from the system or any other appropriate point. While the circulation of the solution is taking place at elevated temperatures, the extractant and surfactant vaporizes to invade areas of the process to condense, capture and remove contamination.

One of the great advantages of the cleaning method of this invention is its flexibility with respect to the ability to clean the entire process equipment or any parts thereof. Simply stated, the steps of the invention from the beginning of the turnaround situation involves the shutdown and draining of the entire process plant, whether a petroleum refinery, a petrochemical plant, or the like. Normally, this draining will occur while the plant equipment is still hot, followed by an optional flush with a light solvent to remove soluble hydrocarbons. A sufficient amount of water would be introduced into the process flow equipment to provide a head for pumps, preferably the process pumps, to be used to circulate it through the process flow equipment to be cleaned. Circulation through the system would best be at a rate at least about turbulent flow. Normally, this flow rate would be from 500 to about 5,000 gallons per minute depending upon the size of the plant equipment and pumps used to accomplish the circulation. The preferable flow rates would run from about 800 to about 1,400 gallons per minute. If the flow rate is too quiescent, the entrained contamination may fall out. The amount of water introduced into the equipment being cleaned would be normally enough such that when the pumps are running at the desired flow rate, no cavitation would occur through lack of fluid in the intake of the pump. Normally, the amount of water introduced would be from about 5% to about 25% of the internal volume of the process flow stream being cleaned. Preferably, the amount would be from about 10% to about 18% of the internal volume.

This would be followed by a circulation of water and then a heating of the entire unit by the injection of steam through the process, normally both into the water and the void space of the unit. This is a matter of choice and convenience based on the experience gathered from a particular process. The advantages are that this heats the entire unitary process including the heat exchangers, both shell side and tube side if both are in the process flow-path. This continues until the equipment is heated to a temperature of from about 160° F. to about 270° F., preferably from 185° F. to about 225° F. The steam temperature could be up to about 375° F. to perform the heating step. Then an extractant and surfactant as defined herein are added to the steam and vaporized throughout the system ultimately condensing with the extractant and surfactant on inner surfaces and heating the water being circulated through the entire processing stream using processing pumps for a sufficient period of time, preferably for about 8 hours or until contamination is removed. It has been found that a circulation time of from about 6 to about 16 hours is normally sufficient for effective first round cleaning. The solution may be tested during circulation, using known procedures for the emulsifier activity remaining in the solution. If activity has diminished, or been exhausted, the solution could either be reconstituted by adding extractant and/or surfactant or it can be replaced entirely with virgin, heated aqueous solution.

By adding a known amount of surfactant when the emulsifier activity is tested, the reduction in activity can indicate the level of cleaning. Once thorough cleaning is indicated, the entire process flow is drained and rinsed with water.

The contamination removed is, except for larger solid particles, held in an aqueous emulsion such that an emulsion breaker can be used employing known techniques to separate the water from hydrocarbon and from solids. Since benzene, one of the most troublesome of the contaminants, is water soluble, it must be stripped from the water and captured. The hydrocarbon removed can be sent to a normal slop tank at the refinery and the recovered water to a biopond for biological remediation treatment.

If a significant amount of larger sized solids are recovered, it is advantageous to connect a circulating filter unit to one of the purge points in the process wherein the circulating solution can be diverted to a knock-down tank and filter for removal of particles removed from the surfaces during the cleaning process to be removed from the solutions. Preferably, particles having a size of greater than about 40 microns should be removed in order to protect the plant process pumps from abrasion and wear caused by the pumping of solids. In instances where outside pumps are brought in to accomplish the circulation without use of process pumps, the preferred embodiment would involve removal of the larger solids but the criticality of such removal diminishes considerably.

Thus, the process of this invention solves the overall disposable problems of a plant since the solids can be handled in the plant in a safe disposal method; the hydrocarbons can go to a slops pit or the API sludges; the volatile hydrocarbons, including benzene, may be stripped from the water and captured in filters such as activated charcoal; and the stripped water can be disposed of in the plant bio-ponds. Heretofore, when prior art processes were used for cleaning the internals of the process, there remained much hazardous waste, particularly in the vapor phase, creating an additional disposal problem at the operating facility as well as failing to eliminate the dangerous benzene exposure to operating personnel.

Using the steps of the present invention as described above results in almost pristine cleaning of the process equipment from the feed pump to the product storage tank in shorter periods of time as compared to prior art methods while maintaining strict safety standards for cleaning personnel. Typically, an entire turnaround of a hydrocarbon process system can be completed in about three fewer days then previous chemical cleaning or steam cleaning techniques.

In such a turnaround situation, it is not uncommon that the plant is contaminated with residual amounts of carcinogens such as benzene, xylene, toluene, and other hydrocarbons, both aromatic and aliphatic. The presence of these gases is detected with various devices and limitations have been set by health and environmental standards which can be safely contacted by humans or what amounts can be released to the environment, respectively. Thus, these materials must be removed before work and maintenance crews can safely enter the vessel. Other cleaning methods and attempts, even using surfactants, fail to remedy the problem created by the volatile organics.

The processing system is normally equipped with attachments where steam at a temperature of from about 212° F. to about 375° F., preferably from about 215° F. to about 350° F., may be introduced for periods of time to condense on the internal surfaces within the vessels, apparatus, pipes, heat exchangers and all process equipment to wash the surfaces to a point where the contaminants may be collected. The steam may also be injected directly into the water to accomplish heating. In the practice of the present invention, the wash fluid may be removed at the end of the process where product is normally collected. Additional washing is often necessary with water and surfactants to gather up residual contaminants. The steam used to heat the solution and the equipment is also, preferably, used to inject a fog of an extractant, preferably accompanied by a surfactant. The extractant can be introduced into the tower with the steam or fogged into any vessel along the process stream where it is vaporized in the steam and carried up into the process equipment where it condenses along with the steam on interior surfaces and trickles down the inside of the vessels. The solution is pushed through the flow-path by the action of pumps contacting the contaminant while flooding the internal surfaces of the plant equipment and thus removing the contamination.

The extractant may be introduced into the steam and injected into the system or added to the circulating water. Yet another alternative is to collect water from the bottom of towers and process low points and circulate it back through the system while injecting steam at convenient locations to heat the circulating water to a temperature of from about 160° F. to about 270° F., preferably from about 185° F. to about 210° F., and then adding the extractant to the circulating water to obtain a concentration of from about 0.1% to about 7% by volume, preferably, from about 1½% to about 5%.

The extractant is chosen from those having an affinity for the contaminant being removed. The criteria for selection are the solubility of the material being removed in the extractant, the vapor pressure and the boiling point of the extractant such that it is within the range of the temperature of the steam and will condense on the surfaces of the metal and in the interstices in the metal, preferably prior to the condensation of the steam, such that the water condensate, as it trickles down to meet the solution flowing through the equipment, washes the internal surfaces of the vessel. The extractant material should be nontoxic and non-hazardous and selected such that it has a high vapor pressure or boiling point within the range of the steam available at the particular plant for use, when injection with the steam is to be practiced, preferably within the range of from about 212° F. to about 375° F., preferably from about 275° F. to about 350° F. Thus, the partial pressure of the extractant will be significant at cleaning conditions.

Preferred extractants having affinity for the scales and contaminants normally found in a hydrocarbon processing unit include materials such as the various terpenes; including, for example, dipentenes, cinenes, cajeputenes, diamylenes, the oils of bergamot, geranium, citronella, dill, and caraway, and the like and related terpenes such as hermiterpenes (isoprenes), sesquiterpenes (caryophyllenes), diterpenes, and polyterpenes. The preferred extractant is limonene, particularly, d-limonene. Mixtures of several extractants may be used satisfactorily with the same criteria as set forth above. Consultation with tables having vapor pressure information and simple experimentation to determine the affinity of the extractant for the contaminating material is all that is necessary to select the mixture and determine relative proportions.

The matter of selecting the satisfactory surfactant is also within the range of one skilled in the art. The boiling point and vapor pressure criteria remain the same, i.e., up to about 375° F. such that the surfactant will also condense at substantially the same time as the steam and the extractant material condenses. This allows the cracks and crevices of the metal and internals of the entire process system, including interstices of the matrix of scaly contamination, to all be invaded by the components of this cleaning system to break down the scale and trap the contaminants into the solution (microemulsion) and remove the troublesome contaminants, especially volatile organics such as benzene. Heretofore, cleaning and decontamination of an entire process plant with disposable non-hazardous materials which are benign to the environment and process seals equipment, especially the seals, and the like was unavailable. No process available safely removed hazardous VOCs, especially benzene, to allow ready access by personnel to equipment for inspection and maintenance. It is a tremendous advantage of the invention to have the ability to not only decontaminate, but clean, the entire process from one end to the other in the same procedure.

The selected surfactants may be anionic, cationic, amphoteric or non-ionic, or mixture from several classes, but the selection specifically is within the experience of the skilled chemist, based upon the material being removed as the contaminant, the extractant being used and the relative amounts which are expected to be taken up into the wash solution from the condensing steam or the circulating water wash. The HLB (Hydrophile/Lyophile Balance) of the surfactants selected preferably should be between 6 and 18 and preferably, between about 7.5 and 12 for the optimum results in the practice of this invention. The characteristics of the members of these classes of surfactants are well known as are the many compounds within these classes. Many surfactants and/or emulsifiers may be selected for use in the practice of the invention depending upon the many and varied process streams which can be cleaned using this invention.

Preferred surfactants are selected from ethoxylated alkyl phenols having an average of from about 6 to about 12 moles of ethylene oxide per mole of alkylphenol, where the alkyl group contains from 8 to 10 carbon atoms. Another preferred component in a surfactant mix is a block copolymer of ethylene oxide and propylene oxide having a molecular weight of from about 1,500 to about 2,500. As a third component in the especially preferred embodiment is a fatty acid alkanolamide which may be, and often is, available in commercial solutions as a 50/50 mixture with a linear alkylbenzene sulfonic acid. Many variations on this theme are well within the scope of the practice of this invention and the components may be varied, as well as their constituents, without departing from the practice of this invention. Combinations of the foregoing materials are especially useful in creating a stable microemulsion with the preferred extractants; i.e., terpenes, and particularly d-limonene. A mixture as described above has a high range of volatility and is found to be useful in contacting and removing many different types of contamination found in hydrocarbon processing units.

Mixtures of surfactants in several of the classes as mentioned above may be used successfully, especially in the situation where a premix of extractant and surfactant is used. This premix would normally be in the form of a microemulsion of several extractants and surfactants. Often, several surfactants would be necessary in order to enhance the shelf life as a homogenous fluid, usually as a microemulsion with water acting as the discontinuous phase in the continuous phase terpene. Of course, the emulsion inverts in the presence of large amounts of water. Such a mixture would be injected in an amount of from about 0.2 to about 0.4 pounds per pound of steam, preferably from about 0.25 to about 0.33 pounds per pound of steam. When added to circulating liquid, the amount would result in an effective amount of the extractant and surfactant being present, usually at a concentration from about 0 1% to about 7% preferably from 1½% to about 5%, and more preferably from about 2% to about 4%. The emulsification of contaminants is an important factor of this invention and those skilled in the art given knowledge of the contaminants and the description herein will be able, with slight experimentation, to select a useful mixture.

In performing the process of this invention from about 0.06 pounds to about 0.3 pounds, preferably from about 0.1 pounds to about 0.20 pounds, of the extractant per pound of steam (or water) should be present. Likewise, the surfactant should be introduced in the ratio of from about 0,001 pounds to about 0.01 pounds, preferably from about 0.003 pounds to about 0,005 pounds, per pound of steam. When both the extractant and surfactant are present, they are present in a ratio of from about 0.5 to about 30 pounds, preferably from about 1.5 to about 10 pounds, of extractant per pound of surfactant. As has been said previously, all of the materials may be introduced simultaneously with the steam or any one introduced with the steam with either other or both of the extractant and surfactant being picked up by the steam, vaporized and transported through the equipment with the steam until condensed. The steam and extractant can be premixed prior to injection into the vessel or injected at separate points in the vessel. Likewise, the extractant, surfactant and steam, all three may be premixed prior to injection. In yet another alternative, the extractant and surfactant, either separately or as a mixture, may be mixed with water at a temperature as set forth above and circulated through the equipment to be cleaned.

Many processes where the invention is useful include distillation columns having reflux systems and demister pads of woven strands of metal at the upper end of the tower, which must also be decontaminated. By carrying the extractant/surfactant steam mixture of this invention upwards through the vessel with condensation occurring at or near the top and even in the reflux equipment itself, the entire tower can be contacted and flushed through the practice of this invention, leaving only the liquid residue at the bottom of the tower for removal by the circulating liquid solution. Similarly, when the embodiment involving use of circulating the solution of extractant and surfactant through the trays and/or packing of a tower while, or after, steaming only a relatively small amount of water emulsion containing the contaminants remains for disposal while a safe, clean tower remains. After the practice of either of these modes of operation for closed decontamination of process towers, entry by workers for inspection, maintenance and repair may be accomplished. After circulation through the entire process, the system, after testing for safety, may be disassembled for such repair or maintenance as is necessary. As another advantage to the practice of this invention, the turnaround maintenance involving certain portions of the equipment may be done on a biannual basis because of the excellent cleaning.

The practice of this invention substantially reduces the time and enhances the results of the cleaning, allowing the process equipment to be put back on stream sooner. As a particular advantage, the process equipment is free from volatile organic compounds (VOCs), especially benzene which is a known carcinogen. Prior attempts at decontamination left residual benzene contamination endangering workers in the equipment. The VOCs would previously collect in the head space of the vessel where they could later be purged to the atmosphere. Such purging is no longer possible under present environmental standards. Using the method of this invention, the benzene is trapped in the solution and removed. After the practice of this invention, testing with instruments indicated undetectable levels of benzene or other VOCs, even without purging the dangerous materials to the atmosphere. After the recovery of the water, breaking of the emulsion and separation of the phases, the water can be stripped using known techniques with the benzene and the VOCs being captured in an appropriate system.

For example, a preferred mixture of extractants and surfactants for cleaning a reaction vessel was prepared using the following components:

TABLE I (Mixture A)

| | Weight Percent |
|---|---|
| d-Limonene | 57% |
| Nonionic copolymer | 9% |
| Monamulse 653-C[2] | 17% |
| Butyl Cellusolve | 3% |
| Nonionic surfactant[3] | 5% |
| Water | 9% |
| | 100% |

[1]Block copolymer of ethylene oxide and propylene oxide having a molecular weight of 1950 and HLB of 12 to 18.
[2]90% active ingredients of a 50/50 mixture of an ethanolamide of a $C_{12}$ fatty acid and a linear alkylbenzene sulfonic acid in 10% isopropanol, b.p. 205° F.
[3]10 mole ethylene oxide adduct of a nonlyphenol.

In another embodiment (Mixture B), the 8% represented by the butyl cellusolve and the nonionic surfactant in the mixture is replaced by a 6 mole ethylene oxide adduct of nonylphenol with an HLB of 10.8.

The above-identified components, when mixed together, form a stable microemulsion of water in the terpene having a long shelf life and exhibiting good solvency for oils or greases, including the lighter materials such as benzene, toluene, and xylene which are trapped and held in the emulsion until removed from the process flow equipment in spite of the elevated temperatures at which the cleaning is performed.

The effluent from the decontamination process will be resolvable into hydrocarbons, solids, and water phases such that the hydrocarbons may be recovered and the water containing soluble light hydrocarbons (especially benzene) can be scrubbed or stripped using a suitable conventional gas stripping operation for environmentally safe disposal. The solids can be removed for incineration and disposal to a land fill.

The following example is introduced to illustrate further the advantages of the present invention for the purposes of instruction and should not be considered as a limitation on the scope of the local application of this invention.

EXAMPLE

This example describes decontamination, using the process of the present invention, of a petroleum crude oil processing stream including a furnace, crude atmospheric distillation tower, and vacuum tower, with attendant heat exchangers.

A circulation loop was installed to allow the surfactant, extractant, and heated aqueous solution containing about 2% of Mixture B (above) to be pumped through a process system at a temperature of about 210° F., was formed by connecting flow lines between a filter truck, a series of pre-heat heat exchangers, a petroleum furnace, a crude atmospheric tower, a vacuum tower, and back to the filter truck. A pump on the filter truck initiates the flow of the surfactant, extractant, heated water solution of the present invention through the flow-path of the crude process in the circulation loop. After circulation for about ten hours, the system was drained and opened for inspection and appeared remarkably clean to experienced workmen.

Normal procedures were then followed for decoking the furnace except that no preburn step was practiced. Notwithstanding the change, the decoking time in the furnace was reduced by about 4 hours, the preburn step being unnecessary.

Having described this invention as set forth above, those of ordinary skill in the art could now practice such invention and determine easily the components and parameters for use therein, and may make many modifications and changes of the specific above-described invention without departing from the scope of the claimed invention.

What is claimed is:

1. A process for simultaneously decontaminating chemical or refining process equipment in fluid communication to remove deposited contaminants to clean the process flow equipment for use, maintenance or repair comprising the steps of:

draining the flow path to be cleaned of process fluids;

pumping an aqueous solution at elevated temperatures along the process flow path through equipment in fluid communication along such process flow-path, said aqueous solution containing an effective amount of extractant with an affinity for the contaminants and at least one surfactant having emulsification activity between the contaminant and water, to contact the internal surface of the equipment to allow invasion of interstices of deposits by the extractant and surfactant at a temperature and for a time sufficient to entrap contaminants into the solution; and withdrawing the solution from the process flow-path being cleansed to remove the contaminants from the process equipment with the solution.

2. The process of claim i which includes the step of:

recycling the water, extractant, and surfactant using process equipment pumps through the process flow-path for a period of from about 6 to about 16 hours.

3. The process of claim 2 wherein the extractant is a terpene and the surfactant has an HLB of from about 6 to about 18.

4. The process of claim 3 wherein the terpene is d-Limonene and the surfactant comprises a 6 to 12 mole ethylene oxide adduct of an alkyl phenol wherein the alkyl group contains 8 to 10 carbon atoms, a block copolymer of ethylene oxide and propylene oxide having a molecular weight of from about 1,500 to about 2,500 and fatty acid alkanol amid.

5. The process of claim 4 wherein the temperature of the circulating solution is from about 160° F. to about 230° F.

6. The process of claim 2 wherein the temperature of the circulating solution is from about 160° F. to about 230° F.

7. A process for removal, sufficient to allow human exposure to the interior of process equipment for repair and maintenance, of benzene contamination from a chemical process equipment which has been taken out of service and drained, comprising the steps of:

filling from about 5% to about 25% of the internal process volume of water;

injecting into the process equipment, steam at a temperature of up to about 375° F. while circulating through its chemical process equipment in order to heat the water to an effective temperature to remove contaminants;

injecting into the process equipment, in the presence of the steam, from about 0.06 pounds to about 0.3 pounds per pound of steam of an extractant for the chemical residue in the process equipment having a boiling point of up to about the temperature of the steam being injected;

injecting into the vessel, as an optional component in the presence of the steam up to about 0.2 pounds per pound of steam of a surfactant having an HLB of from about 6 to about 18, provided, however, when both the extractant and surfactant are present, they are present in a ratio of from about 0.5 to about 30 pounds of extractant per pound of surfactant;

circulating the heated water, extractant and surfactant through the chemical process equipment for a time sufficient to remove contaminants from the surfaces of the equipment; and removing the solution and chemical residue from the equipment.

8. A process for cleaning hydrocarbon residues and coke from a refinery unit processing a crude petroleum hydrocarbon to produce straight run fractionation products through a flow-path including heat exchangers, crude furnace fractionation towers in fluid communication with each other comprising the steps of:

pumping through crude oil inlet to the system of an aqueous solution at a temperature of from about 180° F. to about 270° F. containing an effective amount of a terpene extractant and a surfactant having emulsification activity between the crude oil, coke deposits and water through the process equipment to contact the contaminated internal surface of the crude oil flow-path equipment to allow invasion of the interstices of contaminated deposits by the extractant and surfactant for time sufficient to entrap contaminants into the solution;

passing the solution through the crude oil furnace to contact the coke and carbon deposits in the crude oil hydrocarbon flow-path;

passing the contaminated solution into crude oil fractionation towers wherein it separates into a heavies bottom solution containing solids and a lighter emulsified overhead solution to continue through the crude oil treater flow-path;

circulating the bottom solution through a solids removal system to provide an aqueous solution of extractant and surfactant for return to the crude hydrocarbon inlet.

9. The process of claim 8 wherein the bottom stream containing solids is removed from the fractionating tower and pumped through a knockout drum and filter to remove solids; and the substantially solids-free aqueous stream being pumped through connections to the fractionation tower reflux line.

10. The process of claim 8 wherein the emulsified overhead solution is treated to break the emulsion; the aqueous solution recovered from the emulsified hydrocarbon is contacted in a stripping vessel with countercurrent flow of a gas to remove benzene contamination overhead leaving a substantially benzene free aqueous stream;

capturing the benzene in a carbon filter; and disposing of the substantially benzene free water.

11. A process for decontaminating process vessels and auxiliary equipment in fluid communication therewith to remove benzene contamination to permit safe human entry for repair and maintenance comprising the steps of:

contacting the benzene contaminated surfaces, at a temperature of from about 160° F. to about 230° F. with an aqueous solution containing a terpene extractant and a surfactant mixture an HLB of from about 6 to about 18;

circulating the mixture through the process vessels and equipment in contact with the surfaces to allow invasion of interstices of the contaminants by the solution for a time sufficient to entrap the benzene contaminants in the solution; and removing the solution from the vessels and equipment to remove the benzene contaminants from the vessels and equipment with the solution.

12. A process for decontaminating a hydrocarbon processing system having a plurality of process equipment in fluid communication to remove hazardous chemical contamination to permit exposure to humans to perform maintenance and repair, said process comprising the steps of:

draining the hydrocarbon process system of process fluids;

flushing the hydrocarbon process system with water and filling the process vessels with sufficient water to establish a head pressure for process pumps;

circulating said water through the system flow-path while heating said water with steam to a temperature of from about 160° F. to about 230° F.;

adding a non-hazardous extractant chemical with affinity for contaminants present in the system and a surfactant having emulsifying activity for said contaminant into said heated water to form a solution;

circulating said solution at a temperature of from about 160° F. to about 230° F. throughout the hydrocarbon processing system for a period of from about 6 to about 12 hours;

removing the circulating solution containing emulsified and entrained solid contaminants; and rinsing the hydrocarbon process system with water.

13. The process of claim 12 which includes the step of:

treating the removed circulating solution to break such emulsion and separate the water from the solid contaminants.

14. The process of claim 12 wherein the circulation rate through the system is from about 800 to about 1400 gallons per minute.

15. The process of claim 12 which includes the step of:

recirculating fresh extractant, surfactant, and heated water through the system.

16. A process for removal of chemical contamination from all or part of a system in fluid communication and which has been taken out of service and drained, sufficient to allow human entry into equipment of the system for repair and maintenance, comprising the steps of:

circulating through the fluid path of the selected system, water in an amount to fill from about 5% to about 25% of the volume of the system while heating the water by injection of steam at a temperature of up to about 375° F.;

adding to the water circulating through the system, in the presence of the steam, from about 0.06 pounds to about 0.3 pounds per pound of steam of a terpene extractant for the chemical residue in the system having a boiling point of up to about the temperature of the steam being injected;

circulating through the system, as an optional component, in the presence of the steam, up to about 0.2 pounds per pound of steam of a surfactant mixture having an HLB of from about 6 to about 18, provided, however, when both the extractant and surfactant are present, they are present in a ratio of from about 0.5 to about 30 pounds of extractant per pound of surfactant;

circulating the heated water, extractant and surfactant in contact with internal surfaces of the equipment within the system for sufficient time to trap chemical contaminants to form a mixture of liquids including trapped contaminants;

pumping the heated liquid through the system at a flow rate sufficient to sweep the liquids and contaminants from the system; and removing the liquids and contaminants from the system.

17. The process of claim 16 wherein the flow rate is from about 800 to about 1,400 gallons per minute.

18. The process of claim 17 wherein from about 0.06 to about 0.3 pounds of extractant per pound of steam and from about 0.001 to about 0.01 pounds of surfactant are injected per pound of steam.

* * * * *

UNITED STATES PATENT AND TRADEMARK OFFICE

CERTIFICATE OF CORRECTION

PATENT NO. : 5,389,156

DATED : February 14, 1995

INVENTOR(S) : Mehta et al.

It is certified that error appears in the above-identified patent and that said Letters Patent is hereby corrected as shown below:

In column 4, line 21 after "gents" insert -- . --.

In column 9, line 29 delete "0,001" and insert therefor -- 0.001 --.

In column 9, line 30 delete "0,005" and insert therefor -- 0.005 --.

In column 11, line 59 delete "i" and insert therefor -- 1 --.

Signed and Sealed this

Twenty-seventh Day of June, 1995

*Attest:*

*Attesting Officer*

BRUCE LEHMAN

*Commissioner of Patents and Trademarks*